United States Patent [19]

Sakata

[11] 3,977,463

[45] Aug. 31, 1976

[54] INCLINED TYPE CENTRIFUGAL CASTING APPARATUS

[75] Inventor: Yoshihiro Sakata, Kitakyushu, Japan

[73] Assignee: Hitachi Metals, Ltd., Japan

[22] Filed: Jan. 13, 1975

[21] Appl. No.: 540,346

[52] U.S. Cl. ..... 164/291; 425/425; 164/286

[51] Int. Cl.[2] ..... B22D 13/00

[58] Field of Search ..... 164/286, 287, 291, 292, 164/298; 249/137; 425/425, 433

[56] References Cited

UNITED STATES PATENTS

| | | | |
|---|---|---|---|
| 1,902,301 | 3/1933 | Camerota | 164/298 |
| 1,963,400 | 6/1934 | Campbell | 164/298 X |
| 2,277,334 | 3/1942 | Tourneau | 164/298 X |

*Primary Examiner*—Ronald J. Shore
*Attorney, Agent, or Firm*—Craig & Antonelli

[57] ABSTRACT

In inclined type centrifugal casting apparatus for producing cylindrical castings, such as rigid rolls, or hollow cylindrical castings, such as thick sleeves, an axial component of force of a rotating molding box is so great as to require being supported by a tail stock. An inclined type centrifugal casting apparatus according to this invention is arranged such that eccentricity occurring between an axis of rotation of the tail stock and that of the molding box is adjusted for smooth operation by an Oldham's coupling mechanism provided between a tail stock shaft and a rotating plate mounted on an end surface of the rotating molding box, the coupling mechanism including a face plate provided on its opposite surfaces with guide grooves or projecting members extending perpendicularly to each other, the face plate being made of a pressure-resisting and anti-seizing alloy metal and there being further provided with a rotating member.

27 Claims, 3 Drawing Figures

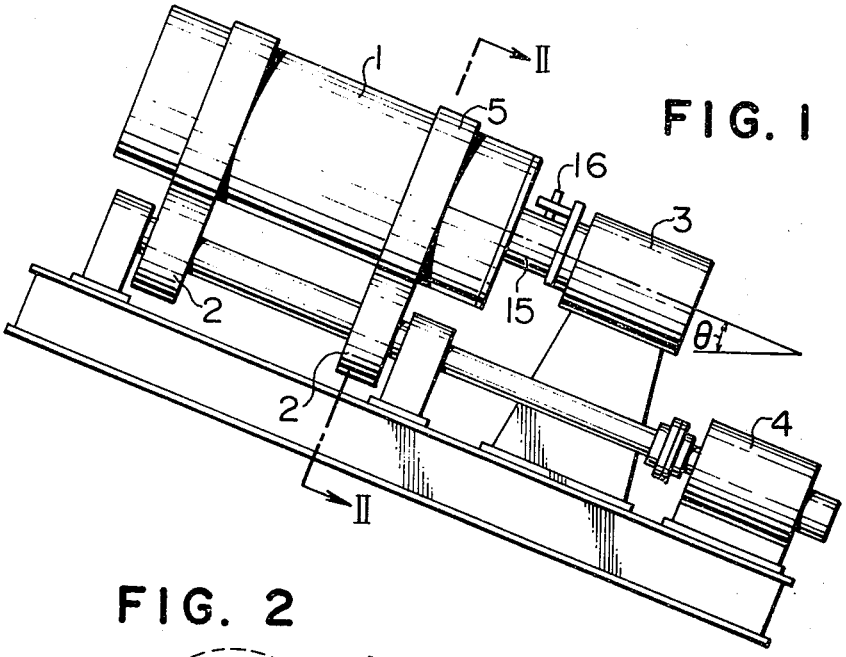
FIG. 1
FIG. 2
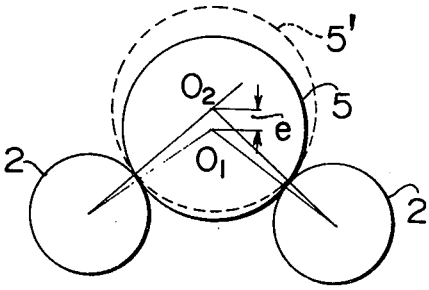
FIG. 3
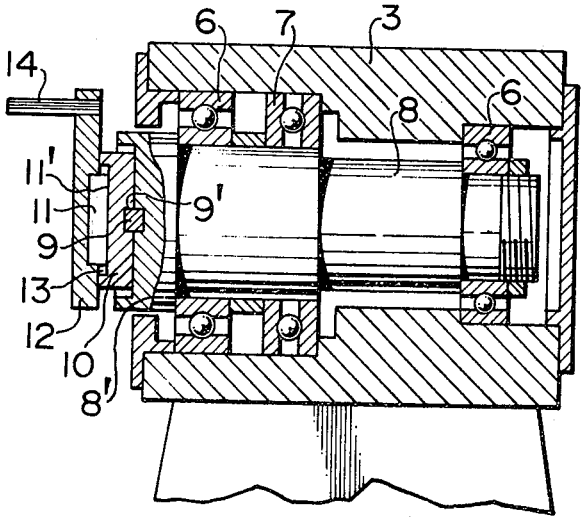

INCLINED TYPE CENTRIFUGAL CASTING APPARATUS

This invention relates to inclined type centrifugal casting apparatus and more particularly to inclined type centrifugal casting apparatus for producing cylindrical castings and hollow cylindrical castings, such as heavy and composite rigid rolls and thick sleeves.

Hitherto, horizontal type centrifugal casting apparatus have usually been utilized for producing cylindrical or hollow cylindrical castings having heavy weight and long length relative to the diameter thereof. However, it is impossible for the horizontal type centrifugal casting apparatus to produce rigid castings, whereas the inclined type centrifugal casting apparatus makes it possible to easily produce the rigid castings. The production of rigid castings by the horizontal type centrifugal casting apparatus is difficult, because the molten metal is not sufficiently filled in the center portion of the castings. It has, therefore, been thought that after the molten metal has been poured to form a cylindrical casting the molding box is vertically stood and then an additional amount of the molten metal is poured in it, but the workability is low particularly for the products, such as rolls, having heavy weight and being inconvenient in handling. In this respect, the inclined type centrifugal casting apparatus is more advantageous than the horizontal apparatus in that the former requires only one pouring process and does not require the complicated operation of the latter apparatus. In the inclined type apparatus, however, the axial component of force of the rotating molding box is great so that there must be provided a tail stock for supporting the axial component of force of the rotating molding box.

It is desirable that the axis of rotation of the tail stock coincides with the axis of rotation of the molding box, but the axis of rotation of the molding box during the casting process is shifted upwardly from its position before the casting process, because the diameter of the rotating surface of the molding box becomes large by heat transfer from the high temperature molten metal poured into the mold. On the other hand, the rotating surfaces of the molding boxes are different in diameter by working error and recutting thereof and thus it is difficult that the axis of the molding box coincides with that of the tail stock and there is an amount of eccentricity therebetween. By this eccentricity, a surface pressure due to the axial component of the weight of the molding box is generated on the contact surfaces of the rotating molding box and tail stock so that sliding and oscillating movements take place to provide failure of the contact surfaces by seizure. Such failure results in the occurrence of vibration and loss of driving power to the molding box thereby degrading the products and disturbing the normal operation. It has hitherto been proposed to use a tail stock provided with a resilient plate, such as rubber plate, between the end surface of the molding box and the front surface of the shaft of the tail stock to absorb the eccentricity. However, the eccentricity, the axial component of the total weight of the molding box and the temperature at the end portion thereof exceed 2 mm, 5 tons and 150°C, respectively, such a plate can not be used due to peeling-off and erosion resulting from the shearing force.

An object of this invention is to provide an inclined type centrifugal casting apparatus having a tail stock absorbing the eccentricity for smooth operation.

Such an object of this invention is achieved by the provision of a tail stock in which a face plate having in its opposite surfaces guide grooves extending perpendicularly to each other is provided between a tail stock shaft and a rotating plate disposed on an end surface of a rotating molding box, and projecting members provided on said rotating plate and the end portion of the tail stock shaft respectively are slidably engaged with said respective guide grooves thereby forming an Oldham's coupling mechanism.

Further objects and advantages of this invention will be more clearly understood from the following detailed description taken in conjunction with the accompanying drawings in which:

FIG. 1 is a schematic side view of an inclined type centrifugal casting apparatus embodying this invention;

FIG. 2 is a sectional view of the apparatus of FIG. 1 taken along the line II—II shown in FIG. 1; and FIG. 3 is an elevational view in section of a tail stock of the apparatus of FIG. 1.

Referring first to FIG. 1, a molding box 1 has an axis inclined at an angle $\theta$ from the horizontal plane and the lateral and axial components of its weight are supported by rollers 2 and a tail stock 3 which are also inclined at the angle $\theta$. The molding box 1 is rotated by frictional contact between the rollers 2 driven by a motor 4 and rotating surfaces 5 of the molding box.

When the rotating surfaces 5 of the mold frame vary from 5 to 5' by thermal expansion as shown in FIG. 2, the center of rotation of the molding box 1 is shifted from $O_1$ to $O_2$, but the axis of the tail stock 3 is not shifted from $O_1$ and thus there is caused an eccentricity $e$ between the axis $O_2$ of the molding box 1 and the axis $O_1$ of the tail stock 3.

As shown in FIG. 3, a shaft 8 is supported by radial bearing 6 and thrust bearing 7 in the tail stock 3. A stud 9 which is square in section is partially embedded in an end portion 8' of the shaft 8 and is secured to the latter by appropriate means, such as bolts, to form a projecting member 9. Also, a stud 11 which is square in section is partially embedded in a rotating disc 12 and is secured to the latter by suitable means, such as bolts, to form a projecting member 11. Furthermore, a face plate 10 interposed between the end portion 8' of the shaft 8 and the disc 12 is provided on its opposite surfaces with guide grooves 9' and 11' extending at a right angle to each other in a frontal view of the face plate with the projecting members 9 and 11 being inserted in the grooves 9' and 11' respectively, so that the members 9 and 11 are slidably moved in the grooves 9' and 11' within the range of clearances 13 to provide an Oldham's coupling mechanism for transmitting the rotational force. The rotating disc 12 is provided with a dog 14 extending perpendicularly therefrom, and secured to an end 15 of the molding box is an extension 16 which is engagable with the dog 14. The tail stock of this invention is arranged as shown in FIG. 3 and so when the motor 4 rotates the rollers 2 are angularly moved to rotate the molding box 1 through the rotating surfaces 5 thereby transmitting the rotational force to the shaft 8 through the extension 16, the dog 14, the disc 12, the member 11, the face plate 10, the member 9 and the end portion 8'. When the temperature of the molding box 1 rises to cause the eccentricity $e$ as shown in FIG. 2, the members 9 and 11 are slid respectively to absorb the eccentricity $e$ thereby smoothly transmitting the rotational force. The face plate 10 is made of any suitable material having pressure-resisting and anti-seizing properties and it is more preferable to use a special copper alloy, such as aluminium bronze, phosphor bronze or lead bronze, impregnated with solid lubricant, such as carbon.

In this embodiment, the rotational force is transmitted from the molding box 1 to the rotating disc 12, but there is no limitation to such mechanism and any other mechanism for transmitting the rotational force may be used. It is particularly effective to arrange that a plate-like member made of a resilient material, such as rubber or plastics, or a special copper alloy, such as aluminium bronze, phosphor bronze or lead bronze, is secured to the front surface of the disc 12 to support the end portion 15 of the molding box so that the rotation of the molding box 1 is transmitted to the disc 12 by frictional force thereby absorbing vibrations caused by eccentricity.

Furthermore, in the tail stock of the apparatus of this invention, the clearances between the projecting members 9, 11 and the guide grooves 9′, 11′ of the face plate 10 are appropriately increased so that a relatively large amount of eccentricity can be absorbed and the apparatus can satisfactorily operate, even when the temperature of the end portion of the molding box rises highly and a relatively large axial component of the total weight of a heavy molding box is applied to the tail stock. As a result of experiments, it has been observed that the apparatus can be used without any trouble even under the condition of the amount of eccentricity about 10 mm, the temperature of the end portion of the molding box about 450°C and the axial component of force about 13 tons.

Although the embodiment described above is arranged such that the face plate 10 is provided on its opposite surfaces with the guide grooves 9′, 11′ extending perpendicularly to each other and the projecting members 9, 11 disposed on the rotating disc 12 and the end portion 8′ of the tail stock shaft respectively to form an Oldham's coupling mechanism, an alternative embodiment in which the face plate 10 is provided with projecting members instead of the guide grooves 9′, 11′ and the rotating disc 12 and the end portion 8′ of the tail stock shaft are provided with guide grooves instead of the projecting members 9, 11 respectively and the projecting members are engaged with the guide grooves respectively to form an Oldham's coupling mechanism, can bring forth the same function and effect as those of the aforesaid embodiment.

What is claimed is:

1. A centrifugal casting arrangement comprising: a mold means, means for rotatably supporting said mold means with an axis of rotation of said mold means being inclined with respect to a horizontal plane, said supporting means including a rotatable tail stock means for supporting an end face of said mold means and a shaft means rotatably supported by said tail stock means, and means interposed between said tail stock means and said mold means for absorbing eccentricity between the axis of rotation of said mold means and an axis of rotation of said tail stock means including a disc means operatively connected with an end of said mold means, a face plate means interposed between said disc means and an end of said shaft means, projecting means provided on said face plate means, and guide means provided on said disc means and the end portion of said shaft means for receiving said projecting means and guiding the same in predetermined directions so as to absorb any eccentricity between said mold means and said tail stock means.

2. An arrangement according to claim 1, wherein said face plate is made of an anti-seizing and pressure-resisting material.

3. An arrangement according to claim 2, wherein said pressure-resisting and anti-seizing material consists essentially of a copper alloy impregnated with a solid lubricant.

4. A centrifugal casting arrangement comprising: a mold means, means for rotatably supporting said mold means with an axis of rotation of said mold means being inclined with respect to a horizontal plane, said supporting means including a rotatable tail stock means for supporting an end face of said mold means and a shaft means rotatably supported by said tail stock means and means interposed between said tail stock means and said mold means for absorbing eccentricity between the axis of rotation of said mold means and an axis of rotation of said tail stock means including a disc means operatively connected with an end of said mold means, a face plate means interposed between said disc means and an end of said shaft means, projecting means provided at said disc means and at the end portion of said shaft means, and guide means provided in said face plate means for receiving said projecting means and guiding the same during rotation of said mold means.

5. An arrangement according to claim 4, wherein said face plate is made of an anti-seizing and pressure-resisting material.

6. An arrangement according to claim 5, wherein said pressure-resisting and anti-seizing material consists essentially of a copper alloy impregnated with a solid lubricant.

7. In an inclined type centrifugal casting apparatus including a rotating molding box inclined relative to the horizontal plane and rotatably supported by a roller, and a tail stock supporting an end surface of said molding box, the improvement which comprises a rotating disk provided on the end portion of said rotating molding box, a shaft rotatably supported by said tail stock, a face plate made of a pressure-resisting and anti-seizing material and interposed between said rotating disc and an end portion of said shaft, guide grooves formed on opposite surfaces of said face plate and extending at a right angle to each other in a frontal view of said face plate, projecting members disposed on said rotating disc and said end portion of said shaft respectively, and said projecting members being slidable in the respective guide grooves during rotation of the molding box with the direction of sliding movement of the respective projecting members extending in parallel to the respective surfaces of said face plate whereby any eccentricity between the axis of rotation of the molding box and the axis of the shaft of the tail stock is absorbed.

8. An inclined type centrifugal casting apparatus according to claim 7, wherein said pressure resisting and anti-seizing material consists essentially of a copper alloy impregnated with a solid lubricant.

9. An inclined type centrifugal casting apparatus according to claim 7, wherein means are provided on a front surface of said rotating disc for transmitting rotational force from said tail stock to said mold box.

10. An inclined type centrifugal casting apparatus according to claim 9, wherein said means for transmitting rotational force is made of a resilient material.

11. An inclined type centrifugal casting apparatus according to claim 8, wherein means are provided on a front surface of said rotating disc for transmitting rotational force from said tail stock to said mold box.

12. An inclined type centrifugal casting apparatus according to claim 8, wherein said copper alloy is selected from the group consisting of aluminium bronze, phosphor bronze, and lead bronze.

13. An inclined type centrifugal casting apparatus according to claim 12, wherein said solid lubricant consists essentially of carbon.

14. An inclined type centrifugal casting apparatus according to claim 10, wherein said resilient material is a rubber material.

15. An inclined type centrifugal casting apparatus according to claim 10, wherein said resilient material is a plastic material.

16. An inclined type centrifugal casting apparatus according to claim 9, wherein said means for transmitting rotational force is made of a copper alloy.

17. An inclined type centrifugal casting apparatus according to claim 16, wherein the copper alloy is selected from the group consisting essentially of aluminium bronze, phosphor bronze, and lead bronze.

18. In an inclined type centrifugal casting apparatus including a rotating molding box inclined relative to the horizontal plane and rotatably supported by a roller, and a tail stock supporting an end surface of said molding box, the improvement which comprises a rotating disc provided on the end portion of said rotating molding box, a shaft rotatably supported by said tail stock, a face plate made of a pressure-resisting and anti-seizing material and interposed between said rotating disc and an end portion of said shaft, projecting members disposed on opposite surfaces of said face plate and extending at a right angle to each other in a frontal view of said face plate, guide grooves formed on said rotating disc and said end portion of said shaft respectively, and said projecting members being slidable in the respective guide grooves during rotation of the moding box with the direction of movement of the respective projecting members extending in parallel to the respective surfaces of said face plate whereby any eccentricity between the axis of rotation of the molding box and the axis of the shaft of the tail stock is absorbed.

19. An inclined type centrifugal casting apparatus according to claim 18, wherein said pressure resisting and anti-seizing material consists essentially of a copper alloy impregnated with a solid lubricant.

20. An inclined type centrifugal casting apparatus according to claim 19, wherein the copper alloy is selected from the group consisting of aluminium bronze, phosphor bronze, and lead bronze.

21. An inclined type centrifugal casting apparatus according to claim 20, wherein said solid lubricant consists essentially of carbon.

22. An inclined type centrifugal casting apparatus according to claim 21, wherein means are provided on a front surface of said disc for transmitting rotational force from said tail stock to said mold box.

23. An inclined type centrifugal casting apparatus according to claim 22, wherein said means for transmitting rotational force is made of a resilient material.

24. An inclined type centrifugal casting apparatus according to claim 23, wherein said resilient material is a rubber material.

25. An inclined type centrifugal casting apparatus according to claim 23, wherein said resilient material is a plastic material.

26. An inclined type centrifugal casting apparatus according to claim 22, wherein said means for transmitting rotational force is made of a copper alloy.

27. An inclined type centrifugal casting apparatus according to claim 26, wherein said copper alloy is selected from the group consisting of aluminium bronze, phosphor bronze, and lead bronze.

* * * * *